US006764077B1

(12) United States Patent
Miravete

(10) Patent No.: US 6,764,077 B1
(45) Date of Patent: Jul. 20, 2004

(54) FINANCIAL BOARD GAME

(76) Inventor: Paul Miravete, 1323 Echo Creek St., Henderson, NV (US) 89052

( * ) Notice: Subject to any disclaimer, the term of this patent is extended or adjusted under 35 U.S.C. 154(b) by 0 days.

(21) Appl. No.: 10/243,069

(22) Filed: Sep. 12, 2002

(51) Int. Cl.[7] ..... A63F 3/00
(52) U.S. Cl. ..... 273/256; 273/278
(58) Field of Search ..... 273/256, 242, 273/243, 248, 278, 236; D21/334; 434/128

(56) References Cited

U.S. PATENT DOCUMENTS

| | | | | |
|---|---|---|---|---|
| 3,163,423 A | * | 12/1964 | Jackson | 273/256 |
| 3,740,037 A | | 6/1973 | de Bono | |
| 4,014,554 A | | 3/1977 | Krummacher | |
| 4,312,510 A | | 1/1982 | Bodner | |
| 4,431,195 A | | 2/1984 | Brand et al. | |
| 4,452,457 A | | 6/1984 | Atieh et al. | |
| 4,871,177 A | | 10/1989 | Mock | |
| 5,829,747 A | | 11/1998 | Nebel | |
| 5,909,874 A | | 6/1999 | Daniel et al. | |
| 5,918,881 A | | 7/1999 | Kirby | |
| 6,322,076 B1 | | 11/2001 | Fikki | |

* cited by examiner

*Primary Examiner*—Vishu K Mendiratta
(74) *Attorney, Agent, or Firm*—Rob L. Phillips; Quirk & Tratos

(57) ABSTRACT

Disclosed herein is a financial board game that teaches its players about buying and selling securities, about investment strategies, and about the business world. The game as disclosed includes a plurality of spaces forming a closed loop path about the periphery of the board. Many of the spaces are subdivided into subspaces. Some of the subspaces dictate the type of security available for purchase or sale and an indication of price. Other of the subspaces indicate that a question is to be answered by a player. In addition, players each receive a Portfolio Asset Allocation Card which dictates an investment strategy, setting forth the securities that are to be accumulated during the course of the game.

17 Claims, 18 Drawing Sheets

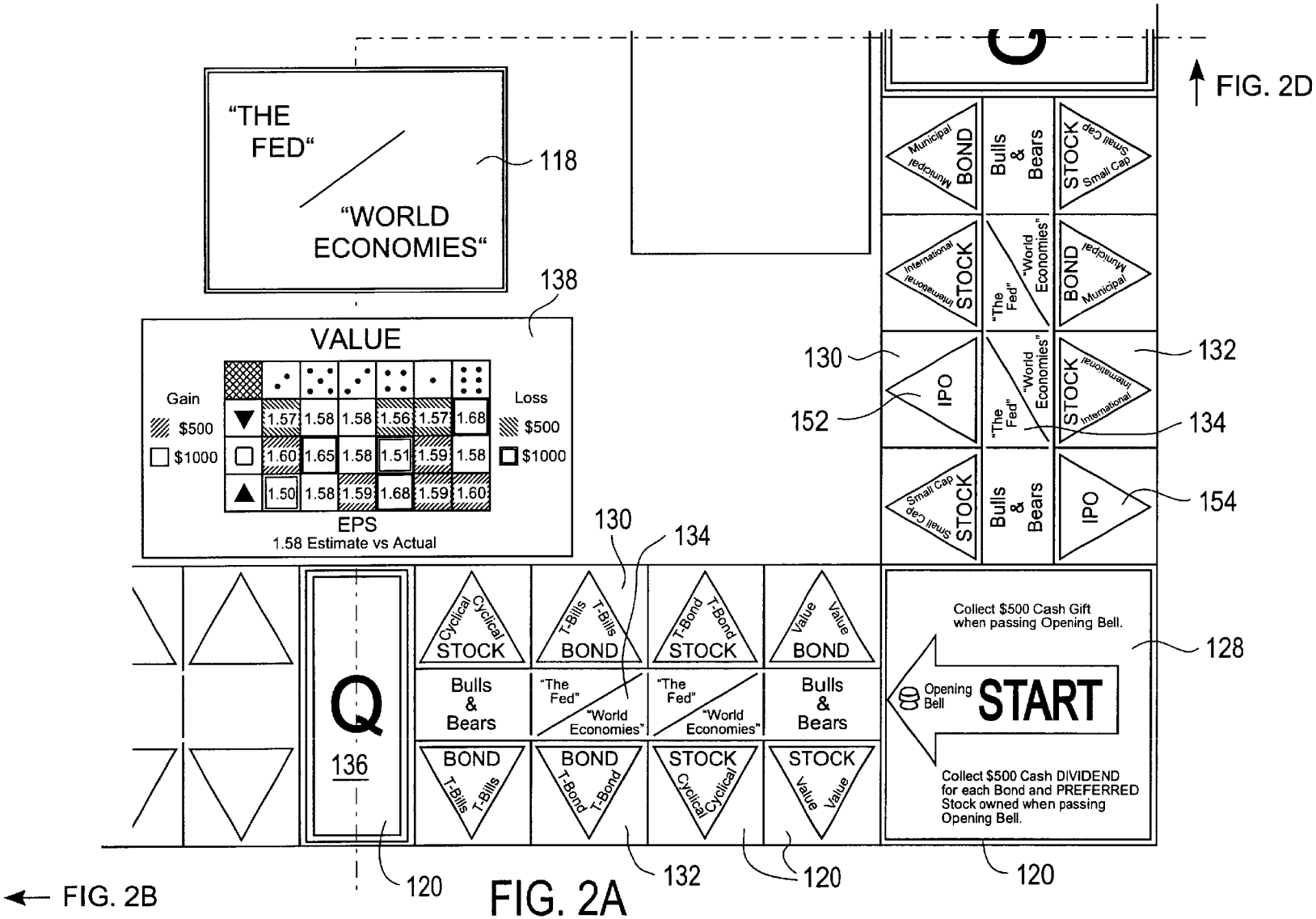
FIG. 2D
132
134
154
128
120
130
152
118
138
136
"THE FED"
"WORLD ECONOMIES"
VALUE
Gain
$500
$1000
Loss
EPS
1.58 Estimate vs Actual
START
Collect $500 Cash Gift when passing Opening Bell.
Opening Bell
Collect $500 Cash DIVIDEND for each Bond and PREFERRED Stock owned when passing Opening Bell.
STOCK Small Cap
BOND Municipal
STOCK International
IPO
Bulls & Bears
"The Fed" "World Economies"
BOND T-Bills
STOCK Cyclical
BOND T-Bond
STOCK T-Bond
BOND Value
STOCK Value
FIG. 2A
FIG. 2B

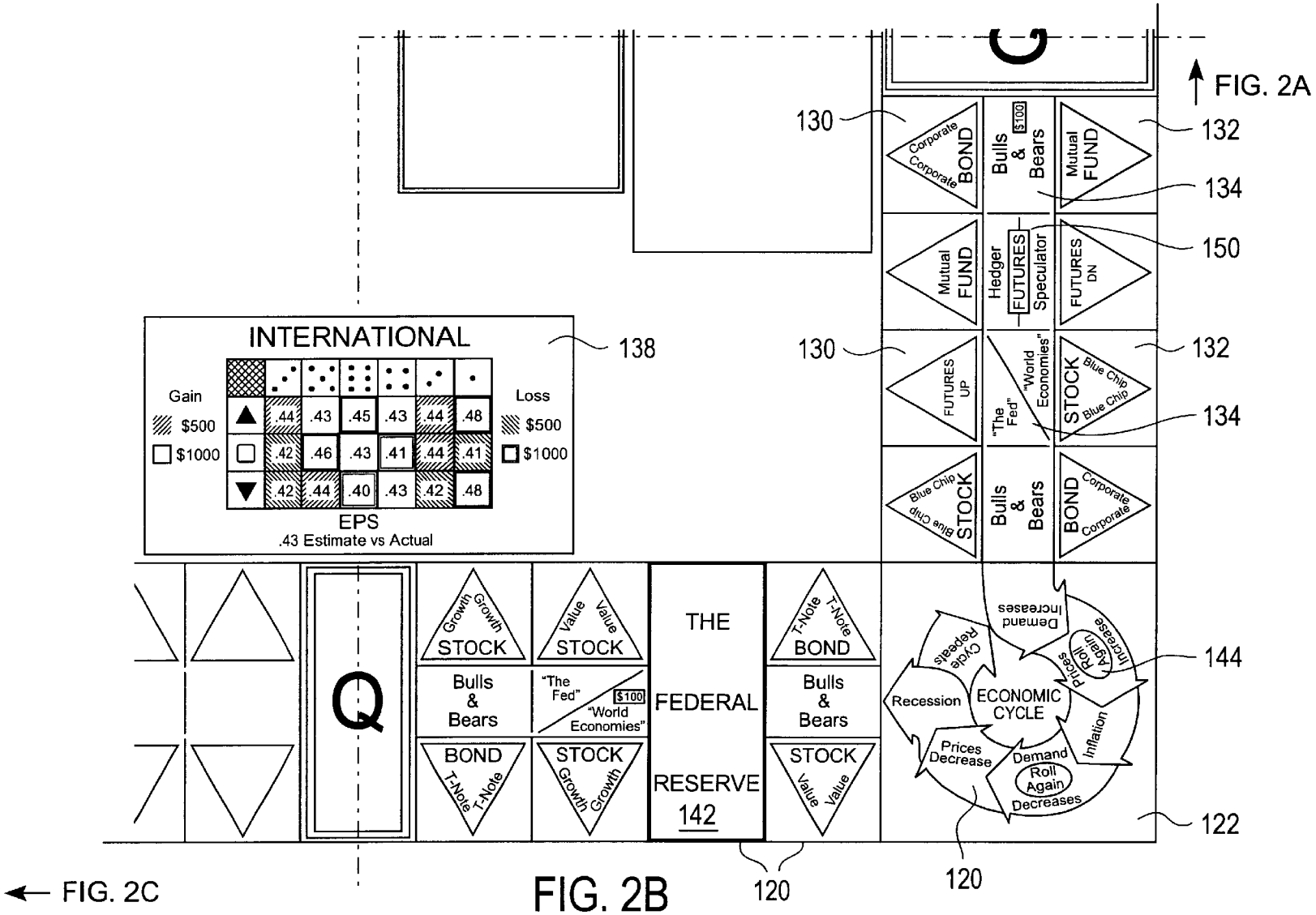
FIG. 2A
132
134
150
132
134
144
122
Mutual FUND
FUTURES DN
STOCK Blue Chip
BOND Corporate
Bulls & Bears $100
Hedger FUTURES Speculator
"The Fed" "World Economies"
Bulls & Bears
ECONOMIC CYCLE
Demand Increases
Prices Roll Again Increase
Inflation
Demand Roll Again Decreases
Prices Decrease
Recession
Cycle Repeats
BOND Corporate
Mutual FUND
FUTURES UP
STOCK Blue Chip
130
130
120
T-Note BOND
Bulls & Bears
STOCK Value
THE FEDERAL RESERVE 142
120
138
INTERNATIONAL
Loss $500 $1000
Gain $500 $1000
.44 .43 .45 .43 .44 .48
.42 .46 .43 .41 .44 .41
.42 .44 .40 .43 .42 .48
EPS
.43 Estimate vs Actual
Value STOCK
"The Fed" $100 "World Economies"
STOCK Growth
Growth STOCK
Bulls & Bears
BOND T-Note
FIG. 2B
FIG. 2C

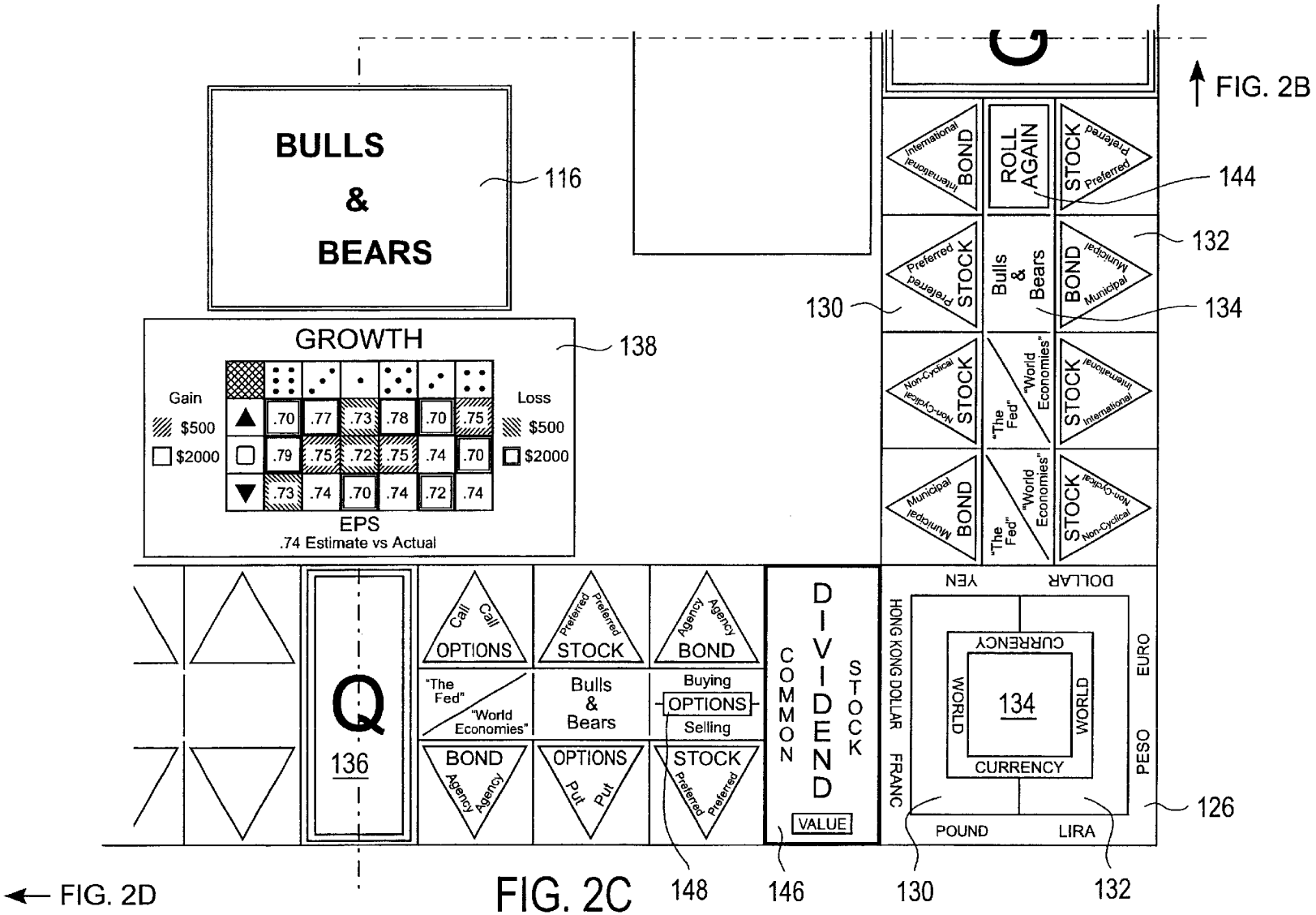
FIG. 2B
144
132
134
126
STOCK
Preferred
BOND
Municipal
STOCK
International
STOCK
Non-Cyclical
ROLL AGAIN
Bulls & Bears
"The Fed" "World Economies"
BOND
International
STOCK
Preferred
STOCK
Non-Cyclical
BOND
Municipal
PESO
EURO
DOLLAR
LIRA
WORLD
CURRENCY
134
CURRENCY
WORLD
YEN
POUND
HONG KONG DOLLAR
FRANC
130
130
STOCK
DIVIDEND
COMMON
VALUE
146
Agency BOND
Buying
OPTIONS
Selling
STOCK
Preferred
Preferred
148
Preferred STOCK
Bulls & Bears
OPTIONS
Put
138
116
BULLS & BEARS
GROWTH
Loss
$500
$2000
.75
.70
.74
.70
.74
.72
.78
.74
.73
.75
.72
.75
.74
.70
.77
.75
.74
.70
.79
.73
Gain
$500
$2000
EPS
.74 Estimate vs Actual
Call OPTIONS
"The Fed" "World Economies"
BOND Agency
136
FIG. 2C
FIG. 2D 132
134
120
144
124
BOND
T-Note
Mutual
FUND
STOCK
Small Cap
BOND
Corporate
Bulls
&
Bears
$1000
"The Fed"
"World Economies"
CYCLE
ROLL AGAIN
MONEY
120
130
T-Bond
BOND
"The Fed"
"World Economies"
$1000
STOCK
Growth
120
140
INFLATION
138
130
Growth
STOCK
Bulls
&
Bears
STOCK
Blue Chip
Blue Chip
STOCK
"The Fed"
"World Economies"
BOND
T-Bond
132
134
SMALL CAP
Loss
$500
$3000
Gain
$500
$3000
.19
.31
.33
.17
.30
.16
.25
.26
.24
.23
.24
.18
.20
.27
.26
.46
.29
.28
EPS
.26 Estimate vs Actual

104

104

104

104

$$ Securities Price List $$

STOCKS

Value & International

Land on UP: Buy or Sell $1000
Land on DOWN: Buy or Sell $500

Growth & Small Cap

Land on UP: Buy or Sell $500
Land on DOWN: Buy or Sell $200

BLUE CHIP space Player can buy - Growth or International stock.

"Blue Chip" must be written on certificate.

Land on UP: Buy or Sell $1500
Land on DOWN: Buy or Sell $1000

NON-CYCLICAL space Player can buy - Value or Preferred Stock.

"Non-Cyclical" must be written on certificate

Land on UP: Buy or Sell $500
Land on DOWN: Buy or Sell $100

CYCLICAL space Player can buy - Small-Cap, Value or International stock.

"Cyclical" must be written on certificate.

Land on UP: Buy or Sell $500
Land on DOWN: Buy or Sell $100

FUTURES rectangle - *(Advanced play)

Refer to instructions.

BONDS

T-bond, T-note, T-bill
Agency Bond, Corporate Bond, Municipal Bond

Land on UP: Buy or Sell $1000
Land on DOWN: Buy or Sell $500

PREFERRED STOCK

Land on UP: Buy or Sell $1000
Land on DOWN: Buy or Sell $500

MUTUAL FUND

Land on UP: Buy or Sell $1000
Land on DOWN: Buy or Sell $500

IPO - "INITIAL PUBLIC OFFERING"

Land on UP: Buy IPO - $3000, Cannot sell IPO
Land on DOWN: Buy IPO - $2000, Cannot sell IPO Only one IPO stock available.

IPO results will be indicated with a green or red arrow on question card when player draws one.

IPO Up - player gets $5000 and returns card for repurchase.

IPO Down - player returns card for repurchase and loses money paid.

OPTIONS rectangle - *(Advanced play)

Refer to instructions.

FIG. 3E

FINANCIAL BOARD GAME

BACKGROUND

Knowledge about investment and corporations is increasingly becoming necessary in order to adequately financially plan for one's future. Nonetheless, many people find learning about stocks, bonds, mutual funds, and other securities and investment vehicles intimidating. Accordingly, many games about the stock market have been developed to help lower barriers to learning about investing. But many of these games fall short: they are far too complicated, they are not engaging, and while they demonstrate how to buy and sell stocks, they fail to teach how to allocate an investment portfolio and fail to teach about the business world as a whole.

SUMMARY

Accordingly, disclosed herein in accordance with an embodiment of the invention is an engaging game that also teaches its players about buying and selling securities, investment strategies (including asset allocation goals for age groups in some embodiments), and the business world.

In particular a financial game in accordance with one embodiment of the invention includes a board having a closed loop path including a plurality of spaces. Each space represents a single playing piece step. Some of the spaces are subdivided into subspaces. In one embodiment, some spaces are divided into at least two subspaces: an up subspace and a down subspace. The up and down subspaces generally each specify a respective type of security that is eligible for purchase or sale when a playing piece is placed on that subspace.

A game in accordance with another embodiment of the invention further includes a number of portfolio asset allocation cards. Each respective portfolio asset allocation card specifies a portfolio of securities for a particular investment strategy. In order to win the game in one embodiment, a player must accumulate the securities and cash specified on that player's portfolio asset allocation card.

In some embodiments a third subspace is included in some of the subdivided spaces, which specifies that a question is to be answered in a particular question category when a playing piece is placed on that subspace. In addition, the game includes a plurality of question cards to be used when a playing piece is placed on such a third subspace.

Finally, a game in accordance with still another embodiment of the invention includes a pair of dice or other move indicator, wherein the first die represents a number indicative of the number of spaces a playing piece is required to advance when the player rolls that die. The second die includes a representation of the subspace in which the playing piece is to be placed once the playing piece has advanced the number of spaces designated by the first die.

In addition, in some embodiments of the invention, there are also securities certificates representative of securities that players will buy and sell. As well, there is play money that is distributed to the players. Finally, there are additional spaces in some embodiments of the invention for special actions, including Quarterly reviews, the Federal Reserve, Inflation, and Roll Again.

BRIEF DESCRIPTION OF THE DRAWINGS

The present invention is described with respect to particular exemplary embodiments thereof and reference is accordingly made to the drawings, which are not necessarily drawn in scale, and in which:

FIGS. 2A–2D are enlarged views of respective portions of the board 102 of FIG. 1;

FIG. 3E illustrates a securities price listing that appears on the back of portfolio asset allocation cards in one embodiment of the invention;

DETAILED DESCRIPTION

Figure 1:
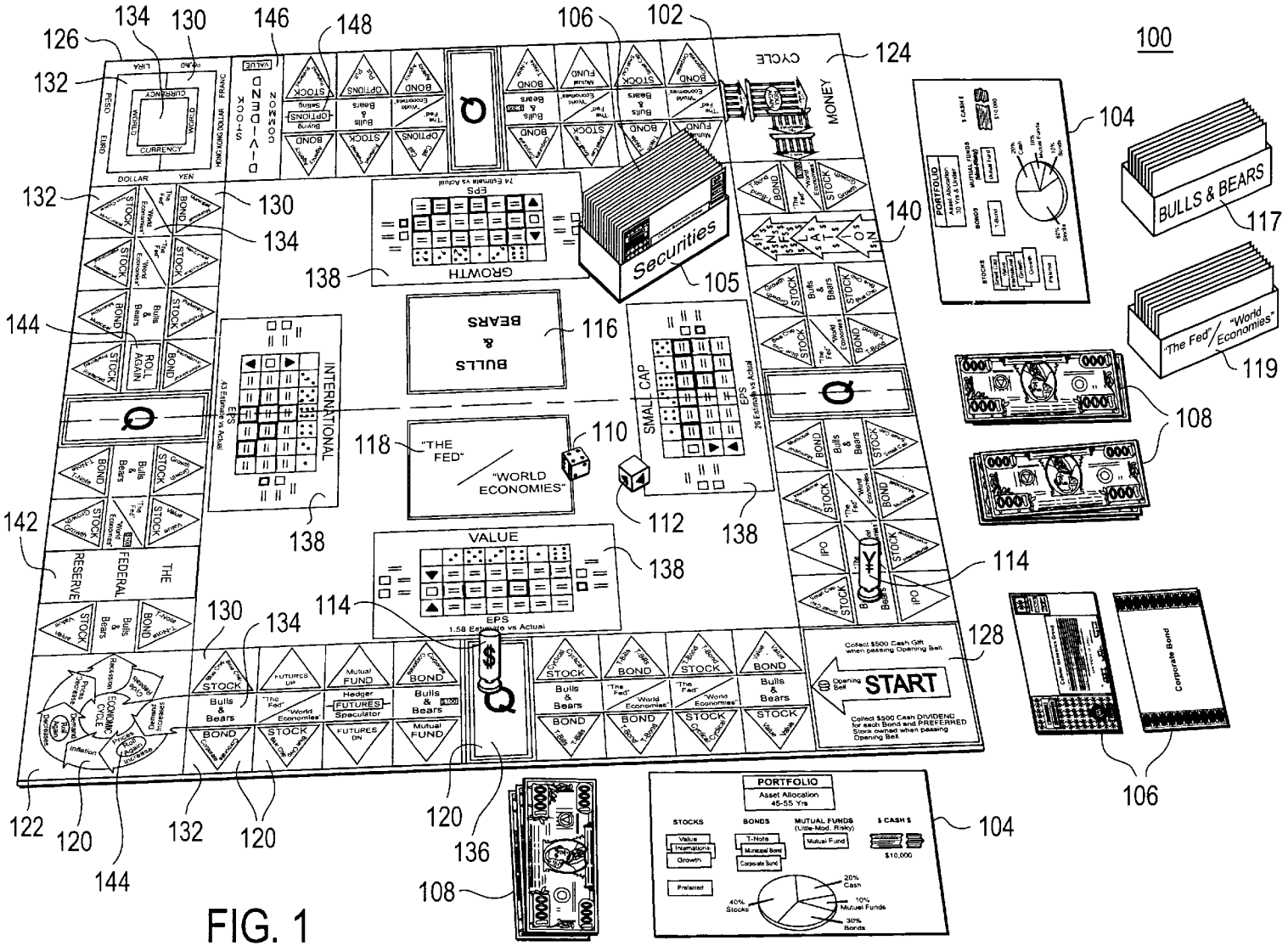
FIG. 1 is an overview of a board game set up for play in accordance with one embodiment of the invention.
Figure 6A:
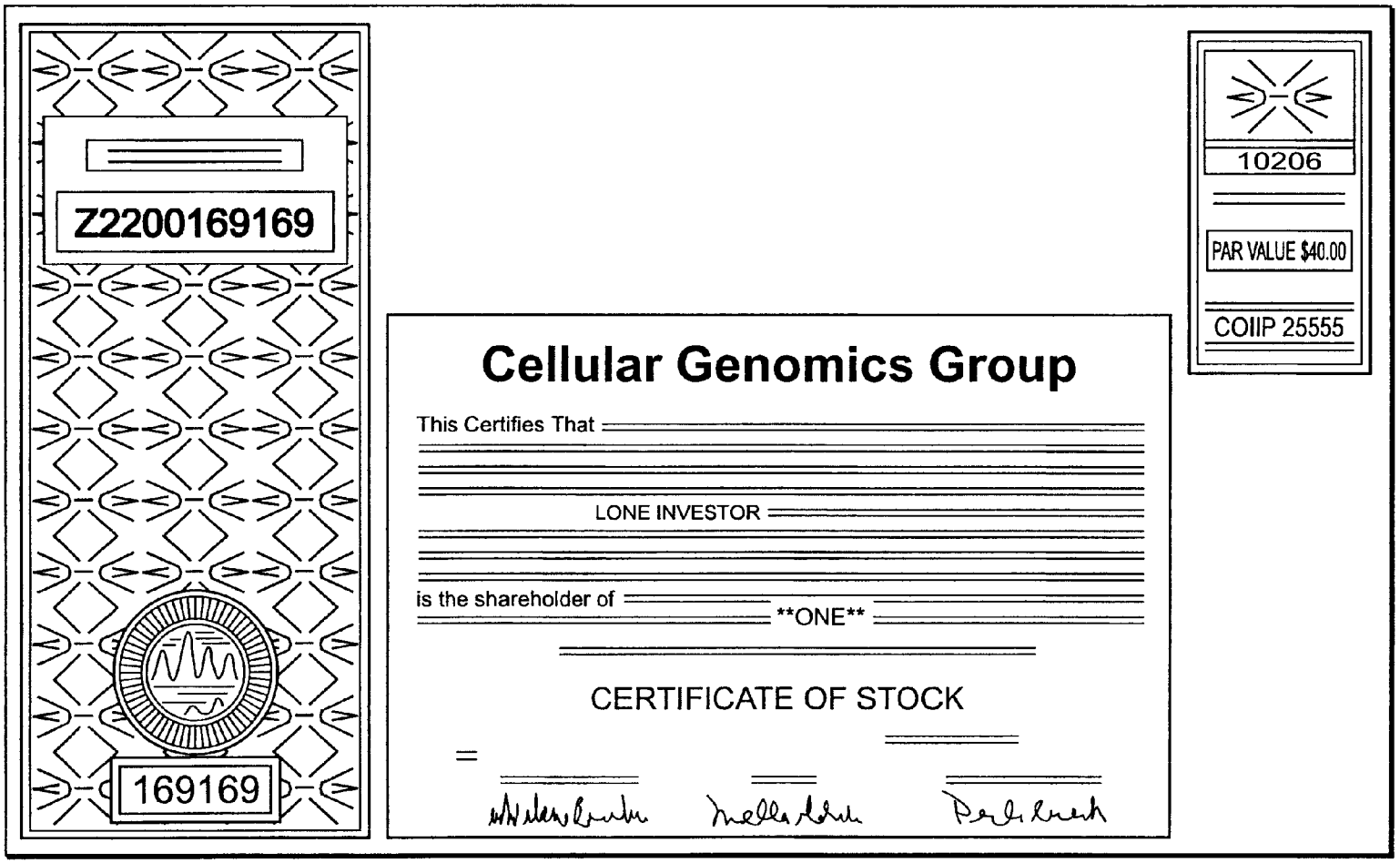
FIGS. 6A and 6B illustrate sample securities certificates 106 used in one embodiment of the invention.
Figure 6B:
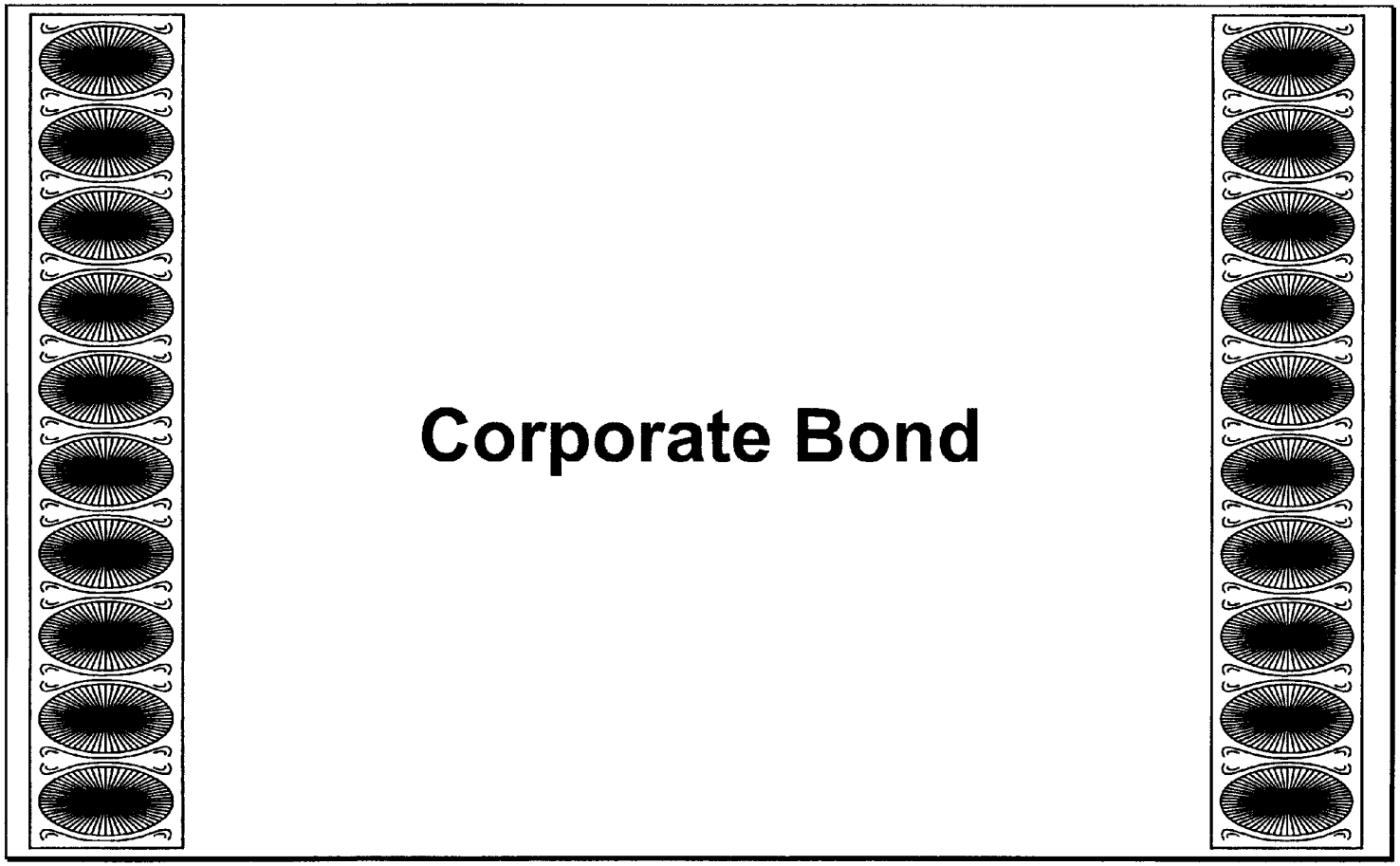
Figure 8B:
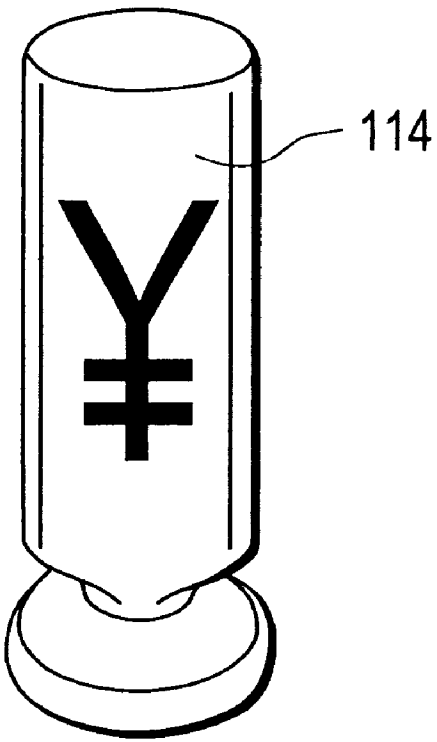
FIGS. 8A and 8B illustrate sample playing pieces 114 that can be used in one embodiment of the invention.
Figure 8A:
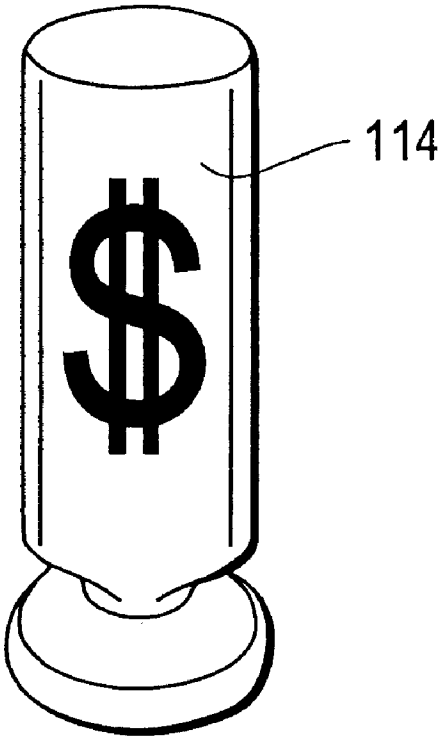

FIG. 1 illustrates a board game 100 set up for play in accordance with an embodiment of the invention. Game 100 includes a board 102, portfolio asset allocation cards 104, securities box 105, securities certificates 106, play money 108 similar to U.S. Federal Reserve notes in $100, $500, and $1,000 denominations, two dice 110, 112, and playing pieces 114 (sample playing pieces representing popular world currencies are shown in FIGS. 8A and 8B). All of the securities certificates 106, including stocks, bonds, mutual funds, IPO, futures, and option certificates, are initially stored inside the securities box 105. Sample securities certificates are shown in FIGS. 6A and 6B. In one embodiment, each securities certificate 106 is labeled as one of a Value Stock, a Growth Stock, an International Stock, a Small Cap Stock, a Preferred Stock, a T-bond, a T-note (bond), a T-bill (bond), an Agency Bond, a Corporate Bond, a Municipal Bond, a Mutual Fund, a Futures Contract, Options, or an IPO. In addition, in one embodiment, some of the stock certificates are additionally labeled "Cyclical," "Non-cyclical," or "Blue Chip."

One of the players will be in charge of the securities box 105 during play of the game, distributing securities to players when they are purchased. In addition, one player of the game will be the banker, distributing to each player $5,000 in play money 108 to start the game. The player responsible to be the banker and the player responsible for the securities box 105 can be different players or the same player.

In addition, the game includes a number of question cards entitled "Bulls & Bears" or "The Fed/World Economies," which are placed on the respective locations 116 and 118. For clarity of illustration question cards are shown in respective boxes 117 and 119 off to the side of the board 102 rather than on locations 116 and 118. The question cards are used to challenge players on many subjects of the world of finance and business such as Top Competitors & Companies, History of Wall St. & Business, Capitalism, Futures & Options, Company Symbols & Sectors, Stocks Bonds & Mutual Funds, Banking-Underwriting-Investing, and Sector & Industry of a Company.

Referring to FIGS. 1 and 2A–2D, one embodiment of the game board includes a closed loop path about its periphery that is divided into a number of spaces 120. Each space 120 represents a single playing piece step taken when advancing a playing piece, e.g., if a player rolls a two on die 110, the player advances two spaces 120. Note that corners 122 and 124 include multiple spaces 120, while corners 126 and 128 consist of only one space 120.

Some of the spaces 120 are further subdivided into subspaces, including an up subspace 130, a down subspace 132, and a middle subspace 134, in some embodiments. As shown on the board 102 in FIG. 1, the up subspace 130 includes a triangle pointing towards the middle of the board while the down subspace 132 has a triangle pointing towards the edge of the board 102. Other embodiments do not require such triangles. Moreover, other embodiments could subdivide the spaces in a multitude of other ways. Subspaces are not "spaces" in that a playing piece is not stepped through each subspace when it advances, but only the space as a whole.

Further, in some embodiments, the triangle in the up subspace is colored green, the triangle in the down subspace is colored red, and the middle subspace is colored blue. Use of such colors is reminiscent of an actual market stock ticker in both physical and practical sense since the prices of securities will cost more when a player buys on the green up subspace and cost less when a player buys securities on the red down subspace. Other embodiments could use different colors or no colors at all.

At the beginning of play, each player is first given a portfolio asset allocation card 104. The portfolio asset allocation cards 104 each define a respective investment strategy. For instance, in one embodiment of the invention, an investment strategy is defined by an age group. Sample portfolio asset allocation cards for age-based investment strategies are shown in FIGS. 3A–3D. Such age-based investment strategies are based on 30 years and under, 30–45 years, 45–55 years, and 55 plus years in one embodiment. Portfolio asset allocation cards can be distributed to each player according to the player's age, or a player can select an age category that is different from his or her own age group, playing a different investment strategy demonstrating to the player the different asset allocation goals for different age groups and/or different risk options in the financial world. Although age is used to determine investment strategy in one embodiment of the invention, different criteria can be used to determine investment strategies in other embodiments.

The object of the game is to accumulate the securities, including stocks, bonds, and mutual funds, and save cash as designated on the respective portfolio asset allocation card distributed to each player. Hence, play ends when the portfolio of a player is complete in accordance with his or her portfolio asset allocation card. The game may also end in some embodiments when a certain time limit is set. The players of various embodiments of the invention can determine the end of the game in accordance with one of these two options. What makes the game appealing for all players is that each individual is involved in the game at all times and for the most part is playing against his or her own ability, trying to complete his or her portfolio asset allocation card by purchasing the required securities and earning cash from investments and correct answers. In most cases by the time one player has completed his or her portfolio asset allocation card most of the other players are nearly complete themselves which keeps all players involved and offers players who have not completed their Portfolio the chance to continue, if so desired, until everyone has finished.

In some embodiments securities, such as stocks, bonds, or mutual funds, will be shown in a different color on the portfolio asset allocation card 104 for easy identification. In some embodiments, these colors will match the colors of the securities certificates 106 that are stored in the securities box 105, hence making for easy identification and retrieval when getting the certificates out of the securities box during the game and for easy teaching of the various terms of the Securities. For instance, in one embodiment, Value Stocks are in green to signify money as Value Stocks generally are safe investments with steady dividend payments. International Stocks are in blue (the color of the planet) to signify world investments, which can be safe investments and potentially promising investments in a growing global economy. Growth Stocks are yellow to signify caution (as in a yellow caution light) alerting the player to potentially risky but also potentially rewarding investments. Small Cap Stocks are in red to alert players of "danger" for high risk companies. Pink is used to signify stocks that are benign in nature as Preferred Stocks commonly are. Bonds are in purple in a neutral color that signifies lending. Mutual funds are in orange to signify collective investing. Both Futures and Options securities certificates have the various commodities and investments involved in the purchase depicted on the certificate itself to help players clearly identify what he or she is purchasing.

In one embodiment of the invention, the back of the portfolio asset allocation card 104 includes prices for securities, as shown in FIG. 3E. Other embodiments of the invention may list security prices in other locations or have a different method for determining such price. For instance, prices could be listed on a separate sheet of paper, in the subspaces identifying a price for the particular security, or even on the securities certificates themselves. In one embodiment, the prices listed are compatible with current dollar values and relative to the investment type. For example, Value and International Stocks will typically cost more in the real world because of their more solid company history, as opposed to Growth and Small Cap Stocks which will cost less because these are typically start-up companies or those that are investing all their money into their growth. Blue Chip Stocks will cost more because as the name suggests they are Blue Chip companies. Non-cyclical and Cyclical will cost less because of their character to be in or out of favor during economic cycles. Bonds, Preferred Stock and Mutual Funds have medium price ranges because of their inherent small risk.

Although portfolio asset allocation cards are used in one embodiment to designate an investment strategy (including an asset allocation) for each player, other embodiments may use other methods to designate such a strategy. For instance, such strategies can simply be set forth in the game instructions.

Figure 4B:
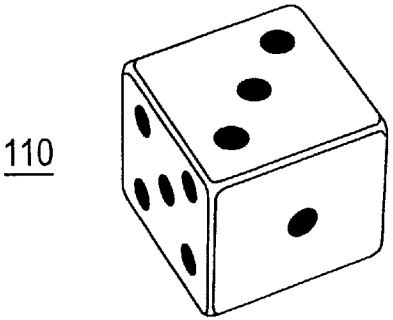
FIGS. 4A and 4B together illustrate all six faces of a first die 110 used in a game in accordance with an embodiment of the invention.
Figure 5B:
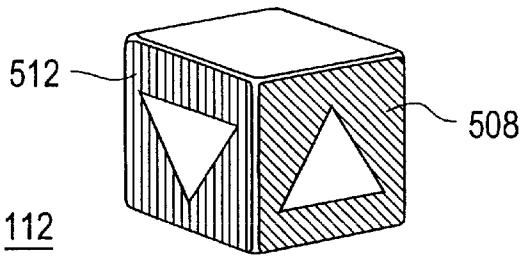
FIGS. 5A and 5B together illustrate all six faces of a second die 112 used in a board in accordance with an embodiment of the invention.
Figure 4A:
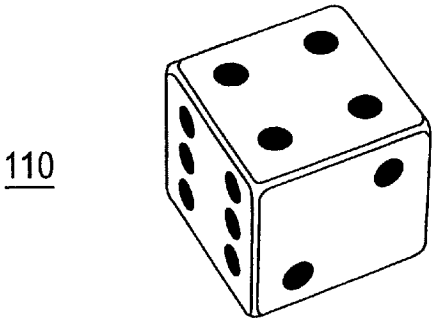
Figure 5A:
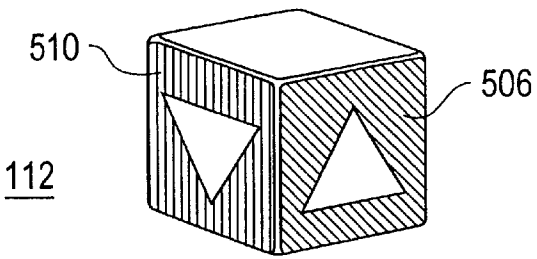

Die 110 is shown in FIGS. 4A and 4B and is a conventional die used in many games having 1, 2, 3, 4, 5, or 6 dots on each of its six faces. Die 112 also referred to herein as a "market trend" die, is also a six-sided die in one embodiment, shown in FIGS. 5A and 5B, but has distinctive markings on its faces. Two of the faces, 502, 504 are blank (a "neutral" indicator). Two of the faces 506 and 508 have an "up" indicator, which indicator can be a word, an arrow, or any other symbol. Two of the die faces 510 and 512 have a "down" indicator, which indicator can be a word, an arrow, or any other symbol. In addition, in some embodiments the faces of the market trend die 112 also include color, such as "green" on the faces with an up indicator, "red" on the faces with a down indicator, and "blue" on the neutral faces. In one embodiment such colors match the colors of the respective up, down, and middle subspaces on the board.

On a player's turn, the player will roll both dice. The player advances the number of spaces 120 shown on die 110, e.g., if a three is rolled on die 110, the player advances three spaces. If the player lands on a subdivided space, the player refers to market trend die 112. The player moves to the up subspace 130 if die 112 shows an up indicator, to the down subspace 132 if die 112 shows a down indicator, and to the middle subspace 134 if die 112 shows a neutral indicator. If after advancing the number of spaces indicated by die 110, the destination space is not subdivided, die 112 is generally ignored (unless required for use with tables 138, described below). Although a pair of dice are used in one embodiment of the invention to indicate a playing piece move, any other move indicator can be used in other embodiments of the invention to indicate a number of spaces to advance a playing piece and the subspace on which to place a playing piece, e.g., one or more spinners.

At the start of the game, each player selects a playing piece 114 and places it on the start space 128. In one embodiment of the invention, every time the player advances around the board and passes start space 128, the player will receive a $500 cash gift and will also receive $500 for each Preferred Stock and $500 for each bond they own when passing this space, helping players understand steady dividend payments of these types of investment vehicles and money received from a cash gift.

On a player's turn the player rolls both dice 110 and 112 and advances his or her playing piece the number of spaces shown on dice 110 and places the playing piece on the appropriate subspace, if applicable, as indicated on die 112. In one embodiment, playing pieces are advanced through the spaces 120 in a clockwise direction. When a playing piece is placed on an up subspace 130 or a down subspace 132, the player may optionally buy the security or sell the security (if the player owns it) described on that subspace. The price of the security for the particular security (e.g., "small cap" stock) will be more expensive when on the up subspace 130 and less expensive when on a similarly labeled down subspace 132, creating a tangible and real simulation of what investors would experience if they were to go and buy securities in the real world. In one embodiment, the back of each portfolio asset allocation card 104, indicates the prices as shown in FIG. 3E, although other embodiments may have different methods to determine security prices.

For instance when a player lands on a down subspace that specifies "Growth Stock," the player can purchase a Growth Stock for $200 (the price specified on the back of the portfolio asset allocation card 104). Although the primary objective of the game is to obtain the securities designated on the player's portfolio asset allocation card, later the player can optionally sell that same Growth Stock back (to the bank) for $500 or to any other player for any price when the player lands on an up subspace labeled "Growth Stock." Alternatively, if a second player lands on a subspace labeled "Growth Stock," and the second player desires to purchase the Growth Stock owned by the first player, the first player may sell it to the second player at a price agreed upon by the two players. In one embodiment, to make an offer to purchase or to sell a security to/from another player, the player must land on a subspace labeled with the security the player desires to purchase/sell. No other trades amongst players are allowed.

Further, several up and down subspaces are labeled "Cyclical," "Non-cyclical," or "Blue Chip." When a player lands on one of these subspaces, the player may optionally buy a stock from the securities box that is labeled "Cyclical," "Non-cyclical," or Blue Chip," respectively. Such a stock can be a Value, Growth, International, or Small Cap, stock as long as it is labeled with the appropriate additional label. Thus, these subspaces provide an alternative way to obtain the various types of stocks.

In one embodiment of the invention, players cannot own more than ten securities at any one time, exclusive of futures, options, and IPO securities, although other embodiments may set different limits or no limit at all. As shown, in one embodiment, players are required to purchase eight securities. Accordingly, allowing a player to purchase ten (or more) securities permits players to exercise some investing discretion outside the required securities needed to complete their individual portfolio asset allocation card, such as buying extra bonds or Preferred Stocks to receive dividends or purchase other stocks to gain profits from the EPS table when landing on the "Q" (quarterly) space, described below. In addition, for the purpose of balancing the player's Portfolio, or to meet the securities ownership limits, if a player is unable to sell a security the player may discard it, returning it to the securities box. The player will lose the money invested for purchasing the security however. A player may also discard the security that had been penalized by the Inflation space 140 (discussed below), returning it to the securities box, in order to balance the player's Portfolio. If the player chooses to discard the security, in one embodiment of the invention, it is done before the player rolls the dice.

If the player rolls a neutral, or middle, indicator on die 112, the playing piece is placed on a middle subspace 134, if applicable. The majority of middle spaces in one embodiment are designated by the question category "Bulls & Bears" or "The Fed/World Economies," although some are designated with "Options" or "Futures" or Roll Again," all discussed below. When landing on a middle subspace 134 that designates a question category, the player answers a question from the designated category. In one embodiment, the player chooses a $100, $200, $500, or $1,000 question. In one embodiment, the $100 questions are the easiest questions with multiple choice answers, keeping less knowledgeable players involved both through the encouragement attained by being able to answer questions correctly and by receiving money for correct answers, while the $1,000 questions are the hardest questions, challenging above average players wanting to demonstrate their knowledge of the financial/business world, with possible multiple choice or no multiple choice answers. In addition in some embodiments of the invention, some question spaces are assigned a dollar value indicating the question difficulty required to be answered by the player, ensuring that players will experience both the easiest and most difficult questions during play. If a question is answered correctly, the player receives money equal to the monetary value of the question. If the question is answered incorrectly, the player receives no money or pays the bank the monetary value of the question. The penalty for incorrect answers can be determined on a game-by-game basis by the players of the game in various embodiments of the invention.

A sample $100 question from the "Bulls & Bears" category is

Q: What is the stock symbol for America Online?

A: AOL.

A sample $200 question from the "Bulls & Bears" category is:

Q: Do stockholders/shareholders have equity in the company in which they have invested?

A: Yes.

A sample $500 question from the "Bulls & Bears" category is:

Q: What service does an investment bank offer to a company going public by buying all of its shares at an agreed-upon price so it can sell them at a profit? (underwriting or consulting)

A: Underwriting.

A sample $1,000 question from the "Bulls & Bears" category is:

Q: In what sector and industry is Ameritrade Holding Corporation—AMTD?

A: Sector—Financial; Industry—Investment Services.

A sample $100 question from "The Fed/World Economies" category is:

Q: Who is a top competitor of Alcoa Inc., leading producer of alumina and aluminum? (Alcan or Sprint Telephone)

A: Alcan-AL.

A sample $200 question from "The Fed/World Economies" category is:

Q: What great world superpower founded New Amsterdam (now Manhattan Island) in the 1620's? (the British, the Spanish or the Dutch)

A. The Dutch.

A sample $500 question from "The Fed/World Economies" category is:

Q: On whose economic strength is the real value of paper money dependent? (the country that issues it or the banks)

A: The country who issues it.

A sample $1,000 question form "The Fed/World Economies" category is:

Q: On what do investors of global bonds need to keep a watch? (Fluctuations of a foreign country's currency or its stock market)

A: Fluctuation of the country's currency.

Figure 7A:
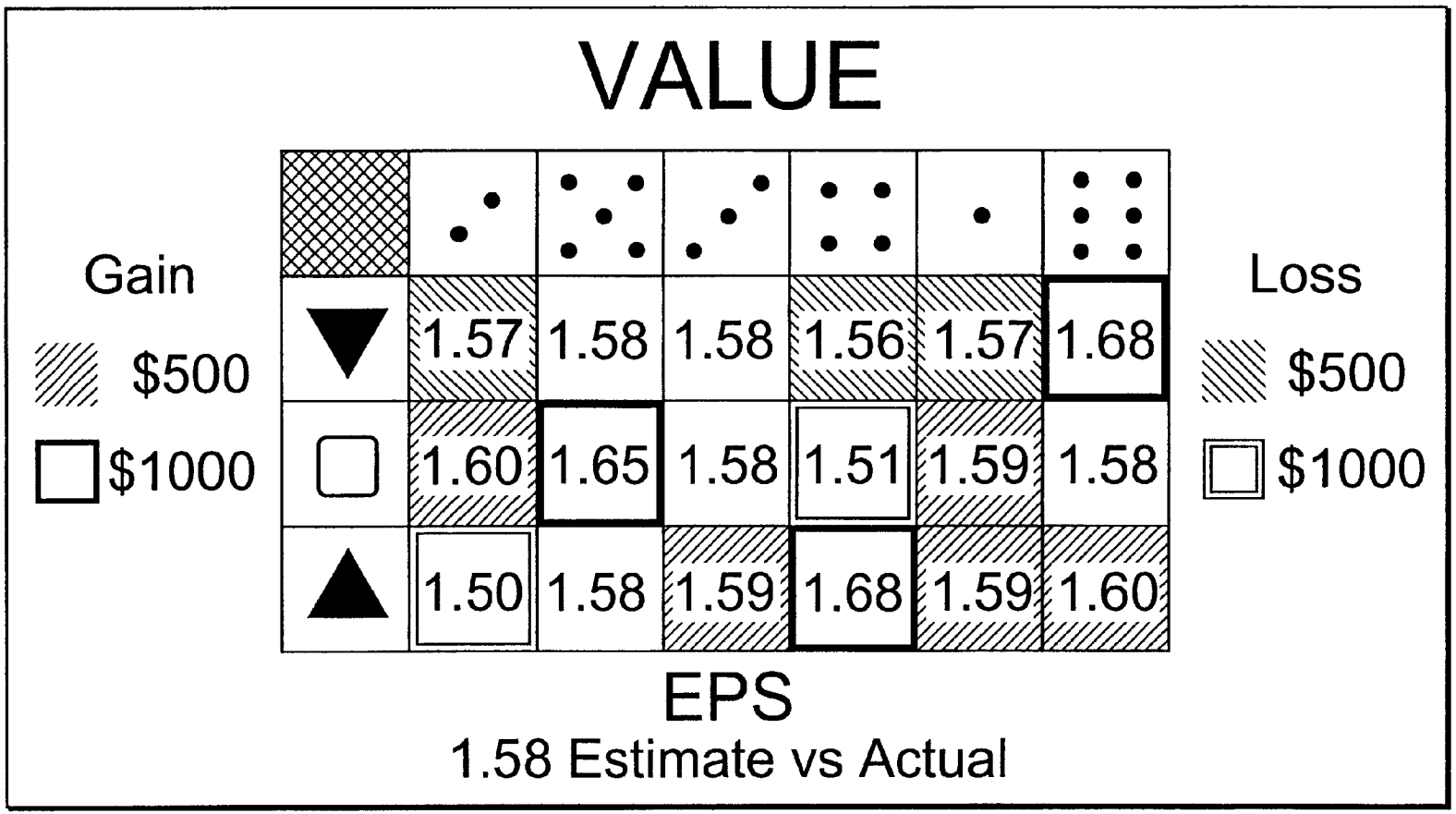
FIGS. 7A–7D illustrate tables utilized when a player lands on a Q space 136 in one embodiment of the invention.
Figure 7B:
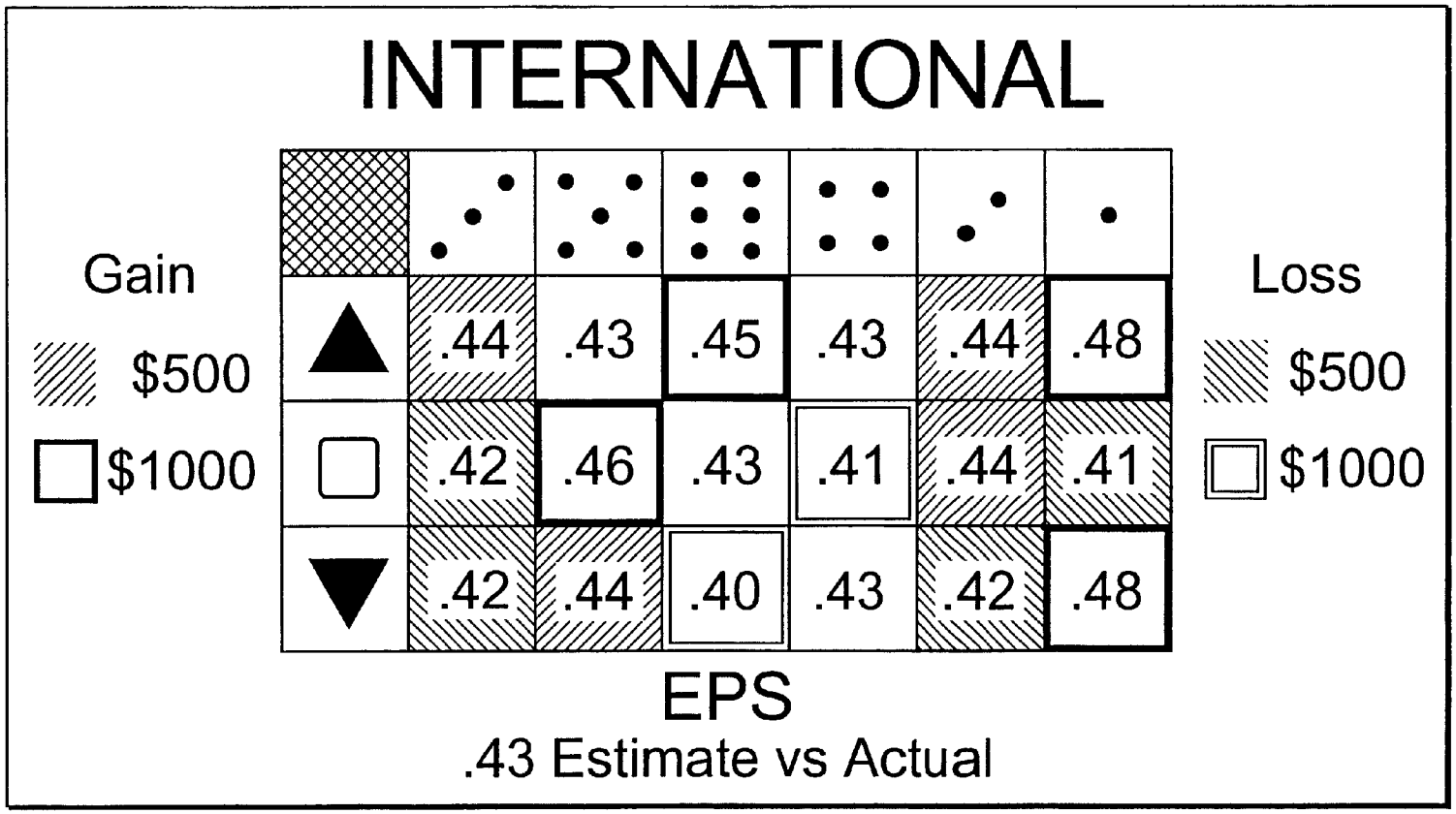
Figure 7C:
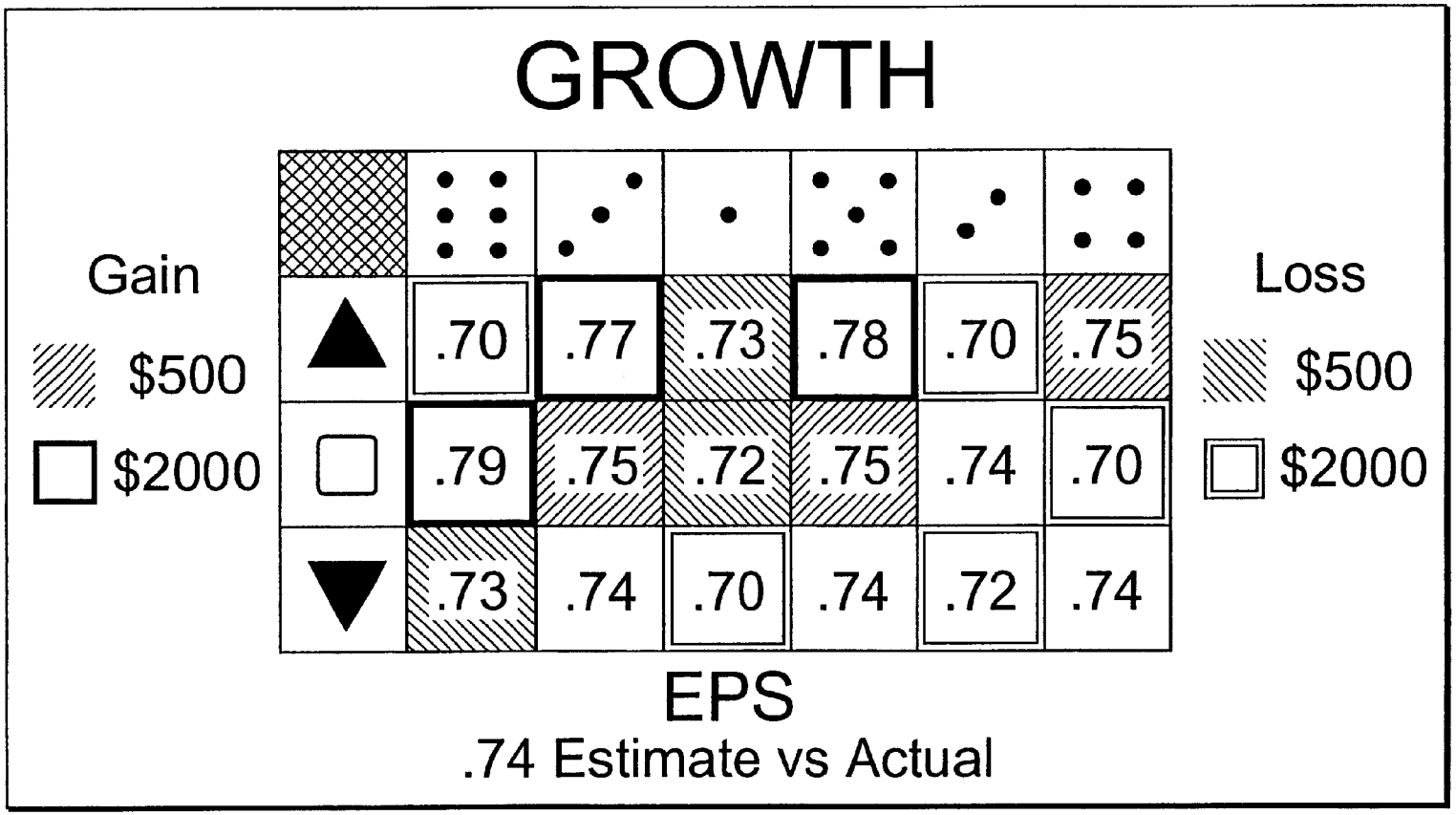
Figure 7D:
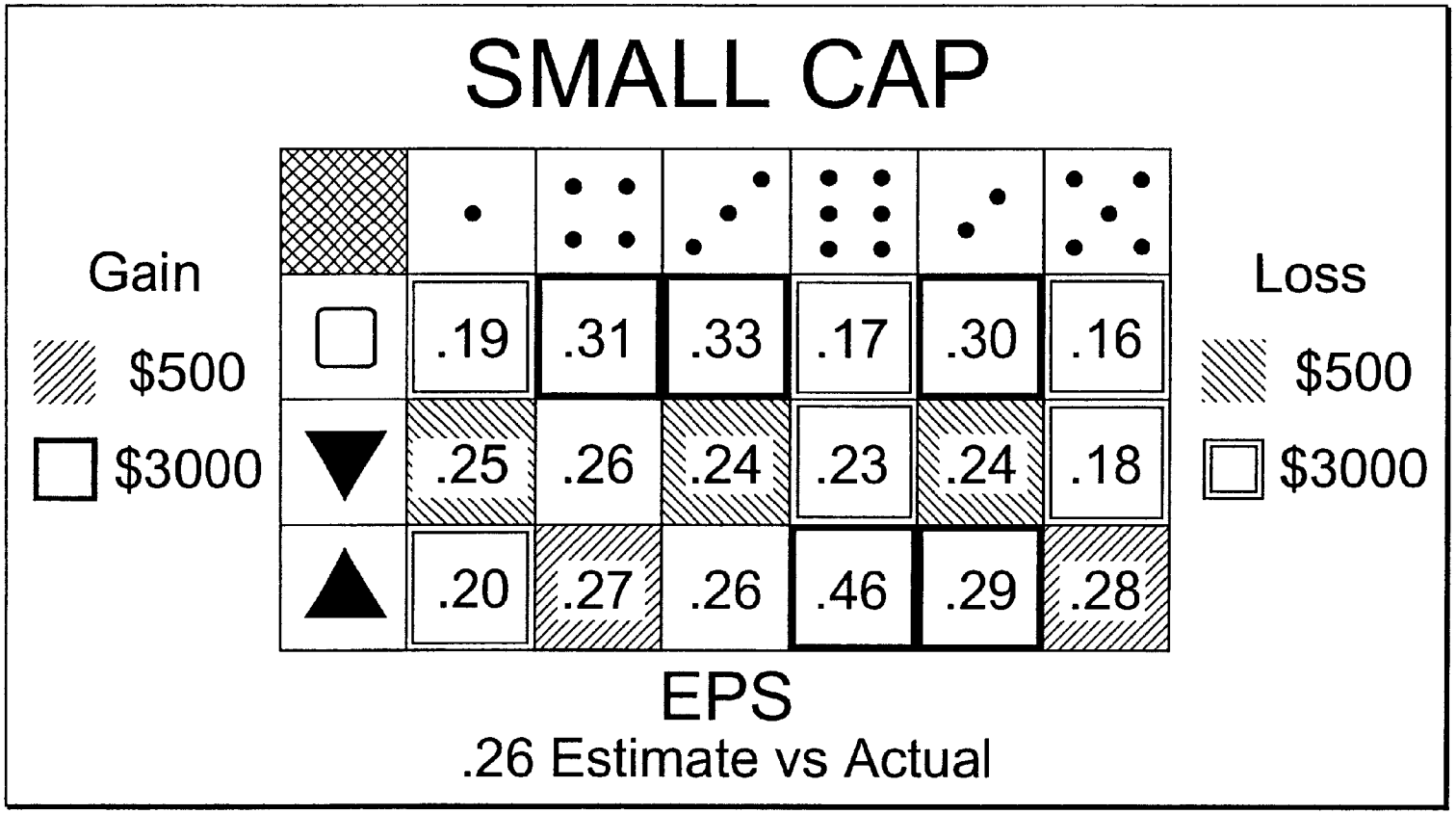

In addition to the subdivided spaces, there are several other types of spaces on the board in one embodiment. The quarterly spaces, or "Q" spaces, 136, help players learn the correlation between owning a particular stock and its potential for earning and losing money through the company's EPS (earnings per share), an important component in the success or failure of a company and which companies announce every quarter. Earnings matched with strong growth are the catalyst to high returns on investment. Accordingly, the "Q" space, or Quarterly space, 136 is an opportunity for the player to make money (capital gain), lose money (capital loss), or break even. Each Q space 136 belongs to one stock category: "Value," "International," "Growth," or "Small Cap." Value Stocks represent stocks of medium to large companies with lower price-to-book ratios, lower forecasted growth (e.g., less than 15%) and higher dividend yields (Low Risk/Low Reward). International Stocks represent stocks of both small and large domestic and non-domestic companies (Medium Risk/Medium Reward). Growth Stocks represent stocks of medium to large companies with superior growth prospects, e.g., 15% or more annually (High Risk/High Reward). Small Cap Stocks represent stocks of small companies with potentially dynamic growth and turnaround capabilities (High Risk/High Reward). When a player lands on a Q space 136, the player looks directly above the Q space to see the category (Value, International, Growth or Small Cap) and an EPS table 138. If the player owns a stock in that category, then the player refers to the table 138 above the Q space to find an entry that is indicated by the roll of the dice. Each table includes values that correspond to the particular stock group. Tables are shown in more detail in FIGS. 7A–7D. For example, the Value Stocks EPS table, FIG. 7A, has 5 of the 18 entries where a player can lose money as a result from poor earnings, 8 of the 18 entries where a player can make money as a result from good earnings, and the remaining 5 entries where a player breaks even. In contrast, the Small Cap EPS table, shown in Table 7D, has 9 of the 18 entries where a player can lose money, 7 of the 18 entries where a player can make money, and the remaining 2 entries a player breaks even.

For instance, if a player owns a Value Stock and the player lands on the Q space 136 directly under the table 138 entitled "Value" (see FIGS. 1 & 7A) then the player refers to dice 110 and 112. In this example, if a player rolled a 4 on die 110 and a "down" on die 112, the player finds the 4 across the top of the table and then goes down to the row demarcated by a down indicator. Hence, in this example, the player loses money because the EPS was $1.56, which is lower than the $1.58 estimate. The player then refers to indicators on the table entry which indicate how much the player has won or lost. As shown in the figures, such indicators are shading and outlining, although colors or other indicators could be used. A legend to the left and the right of the table show the meaning of the indicators. In this example, the shading in the table entry indicates the player lost $500 as shown to the right of the table in FIG. 7A. Multiply $500 times each Value Stock owned. Accordingly, if the player owns two Value Stocks, then the player loses $1,000. The same is done if there is a gain. If the player does not own stock in the category designated by the table, the player does not use the table and does nothing when on that Q space.

The Economic Cycle corner 122 includes several spaces 120 through which a player must move and is designed as a simple means of creating an awareness of real life economic cycles. Players advance through the spaces in the direction of the arrows and exit the corner at the space labeled "recession," towards the "Bulls and Bears" subspace. The arrow labeled "cycle repeats" is not used as a space and is solely for educational purposes. There are no opportunities to win or lose money, buy or sell securities, or to answer questions in the spaces 120 in comer 122 in one embodiment, although as shown, in one embodiment, a player may have an opportunity to "Roll Again."

The Federal Reserve space 142 and the Inflation space 140 are complementary spaces and are designed to help players understand the correlation between the "Fed" and inflation. The Inflation space 140, shown on FIG. 2D, requires that a player landing on this space must set aside one security they own of their choice and partially tuck it under the game board as a penalty in one embodiment. The player may restore the security into the player's Portfolio when the player lands on the Federal Reserve space 142 (see FIG. 2B), which simulates an active "Fed" combating inflation. The player will also receive $500 when the player restores the security to the player's Portfolio. But if the player lands on the Inflation space 140 a second time before the player is able to restore the security, then the player loses the security and must return it to the securities box 105. If the player owns no securities when landing on Inflation space 140, the player pays the bank $500.

There are several Roll Again locations 144 on the board to help move the game along more quickly. When a player lands on a Roll Again location, the player gets to roll the dice again. Two of these locations are spaces in the Economic Cycle corner 122, one of these locations is shown in FIG. 2C at a middle subspace 134, and a fourth location is a space in Money Cycle corner 124 (FIG. 2D).

Figures 2A, 2C, 2D:
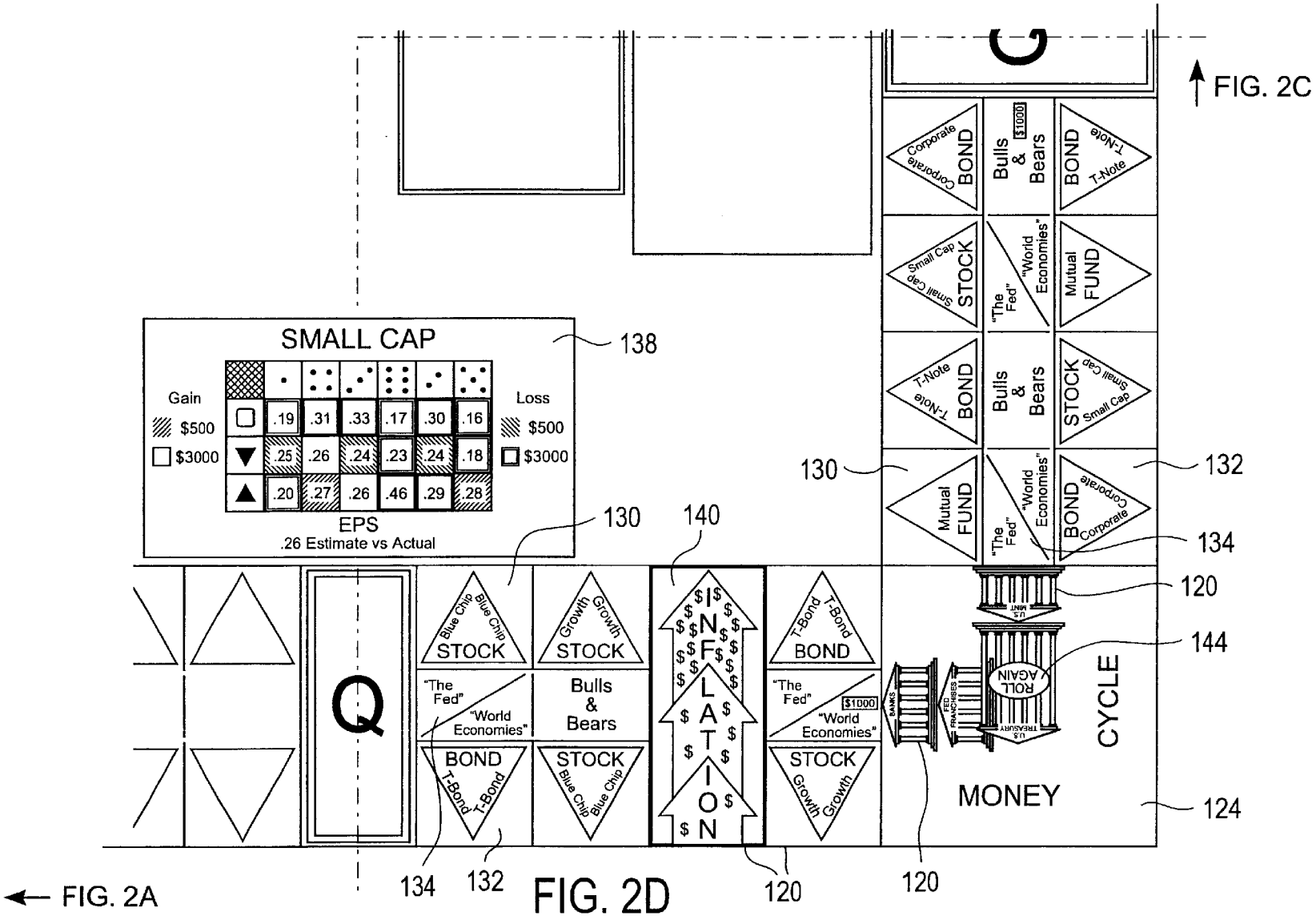
Figure 3A:
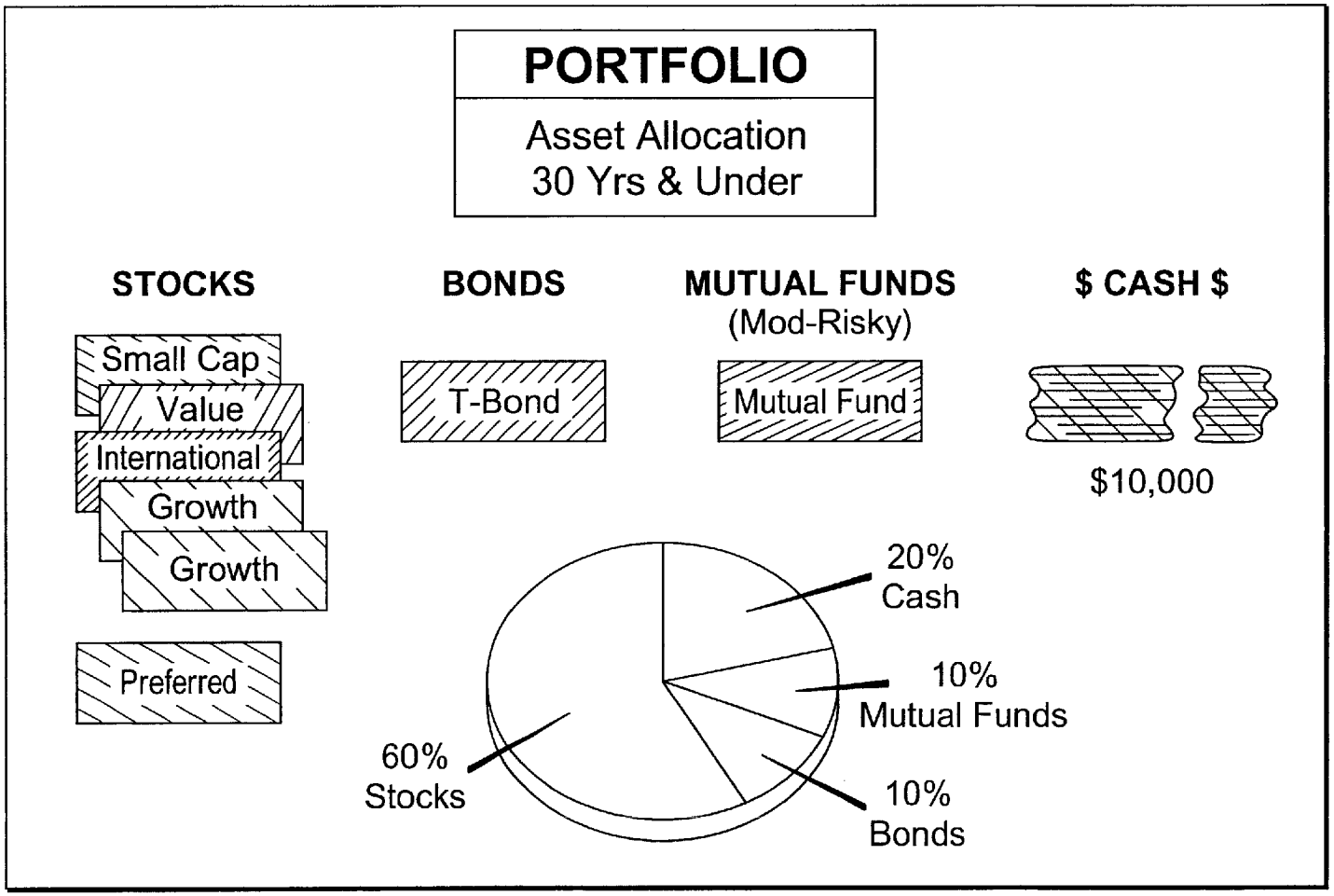
FIGS. 3A–3D illustrate the front of various portfolio asset allocation cards in accordance with one embodiment of the invention.
Figure 3B:
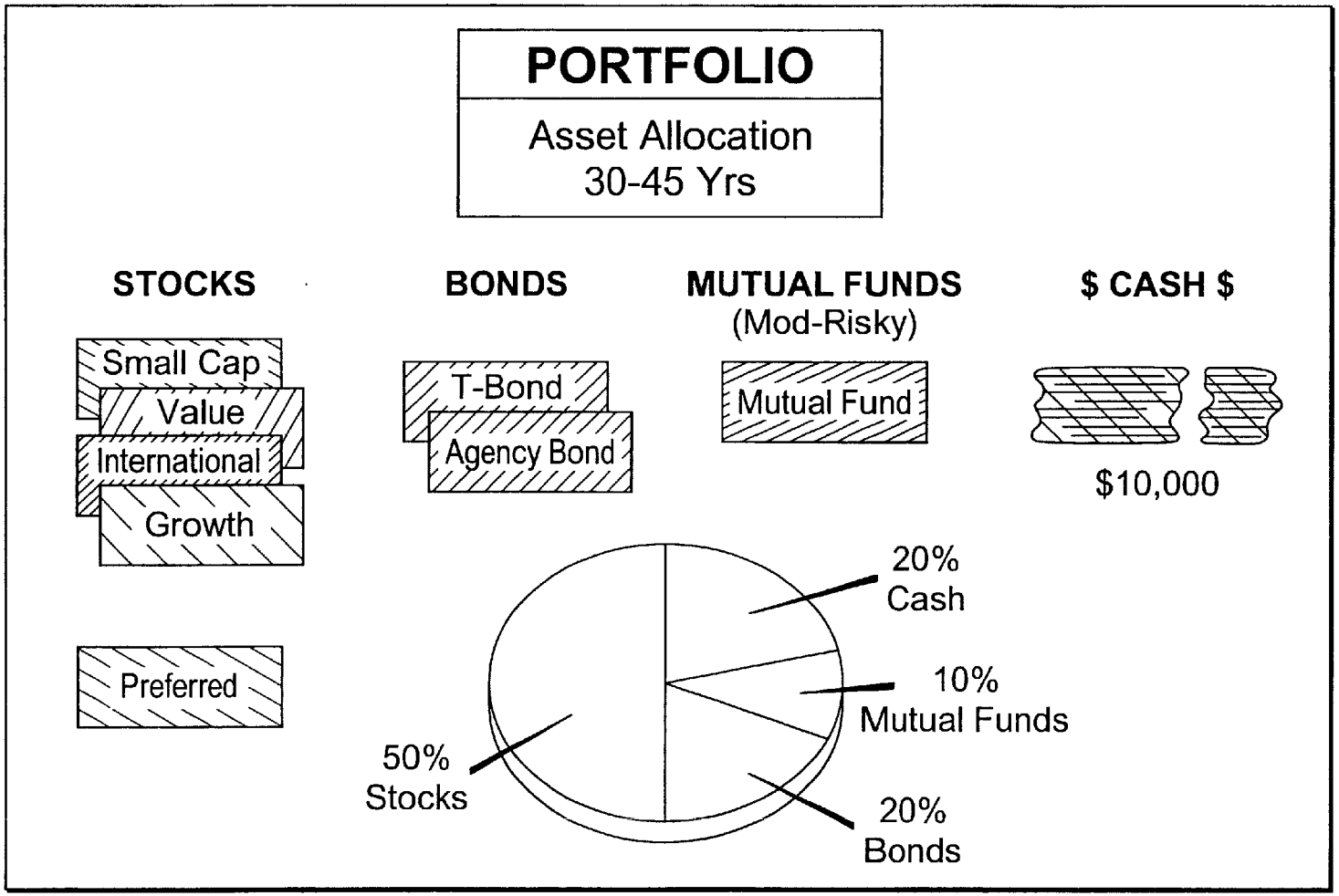
Figure 3C:
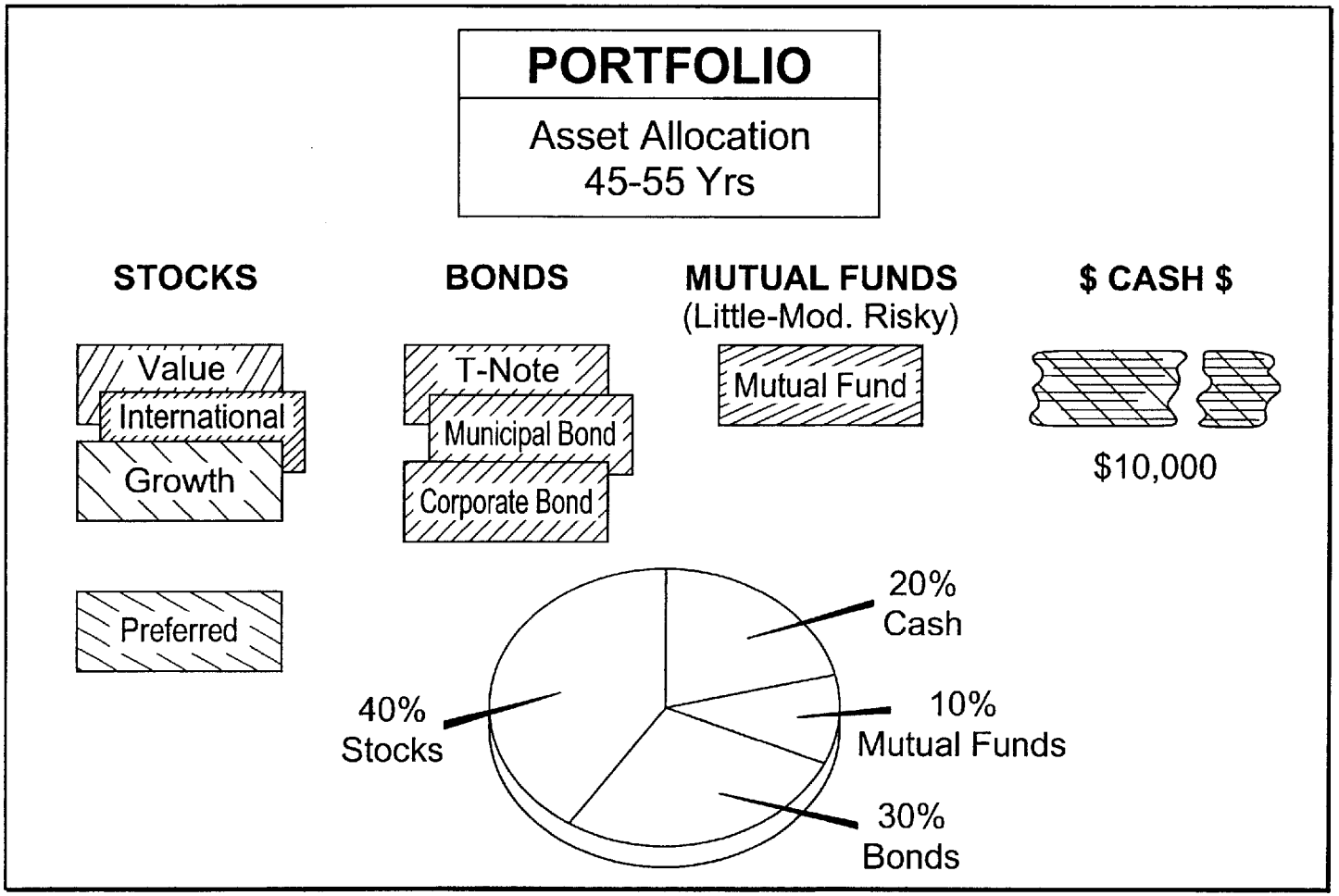
Figure 3D:
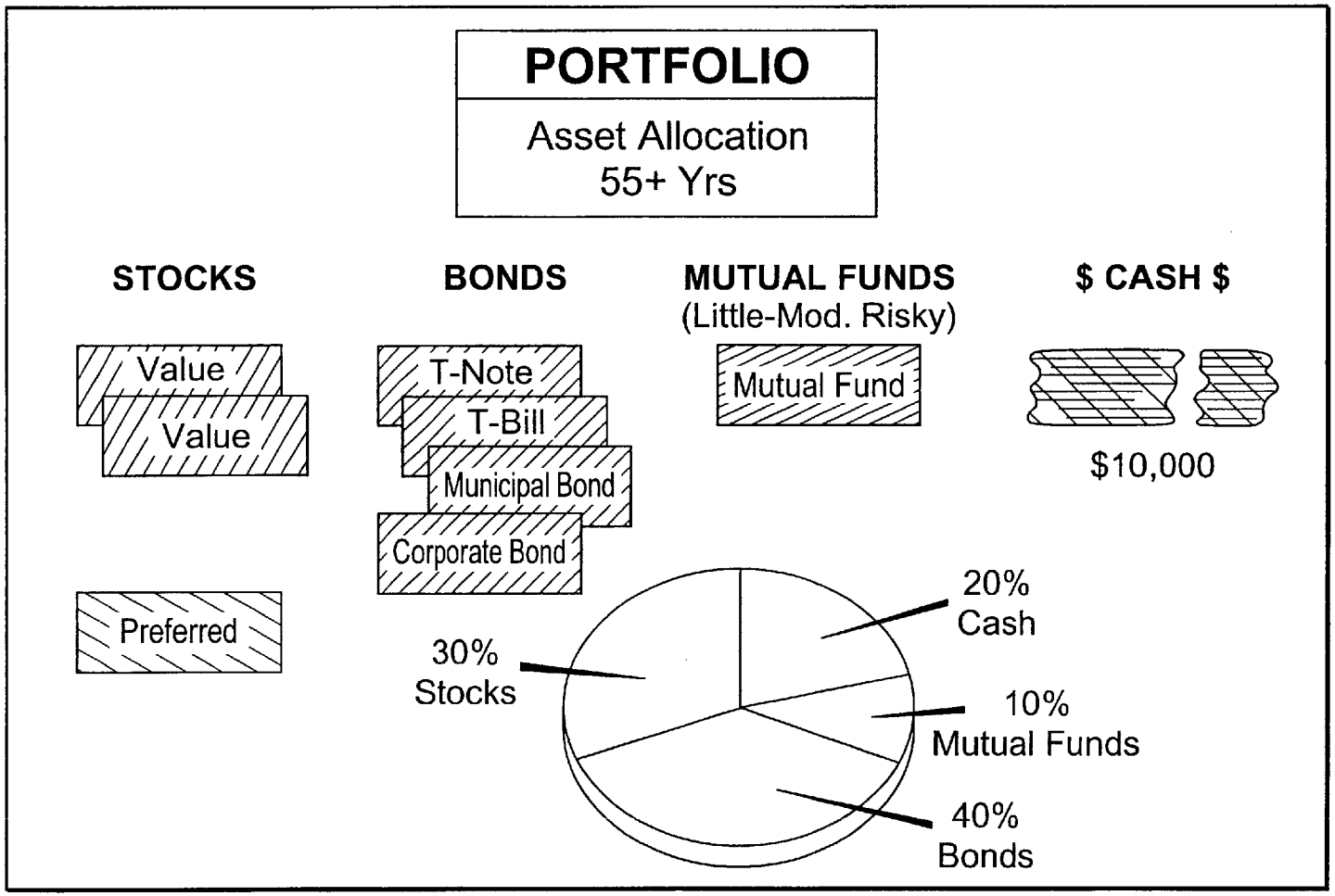

The World Currency (foreign exchange) corner 126 shown in FIG. 2C is a single subdivided space 120, having an up subspace 130, a middle subspace 134, and a down subspace 132. Market trend die 112 is used to determine upon which subspace a playing piece is to be placed. As a space 120, the entire comer 126 counts as one step when advancing a playing piece. Buying and selling foreign currencies plays a major role in world economies, and the price of imports/exports can be greatly impacted by the fluctuation of a government's currency. Thus in the World Currency corner 126, when the player lands on the up subspace, the player will receive $500 from each player that is on any down subspace 132 on the entire game board. In some embodiments, as with spaces 120, colors such as red and green are used to further differentiate the subspaces. If the player lands on the down subspace of corner 126, the player will pay $500 to each player that is on an up subspace anywhere on the game board. If the player lands on the middle subspace of corner 126, the player neither pays nor receives money. The World Currency space is designed to create awareness in the players that currency trading is part of the daily global financial business and the most active market.

The Dividend space 146 (FIG. 2C) entitles a player which lands upon it to receive $500 for each Value Stock the player owns in one embodiment.

The Money Cycle comer 124 (FIG. 2D) has four spaces 120. The spaces in Money Cycle corner 124 do not give a player an opportunity to win or lose money, buy or sell securities, or to answer questions, although one space in comer 124 entitles a player to "Roll Again."

In one embodiment of the invention, a player can become bankrupt, losing all of the player's money, for instance, due to "Inflation," "Stock EPS Losses," penalties for incorrectly answered questions, or "World Currency" hits. When a player has no money and either has to pay the bank or another player, the player sells any security the player owns for the lowest price shown on the back of the portfolio asset allocation card (FIG. 3E) in one embodiment. If a player becomes totally bankrupt, has no cash or securities, the player is not obligated to pay the bank or other players any money due in one embodiment of the invention. In addition such a player is not required to keep track of any debts, but has to rebuild cash capital on hand to $2,500 before being able to buy any securities and maintain $2,500 as their new minimum limit.

There are several specialized subspaces on game board 102. A middle subspace labeled "futures," e.g., 150, allows a player to buy a futures contract for $1,000. The player selects a futures security certificate labeled "speculator," "hedger (producer)" or "hedger (user)." The "speculator" buys the futures contract hoping the price will go up. If the player who holds a futures-speculator certificate lands on a down subspace labeled "futures," the player loses money, e.g., $2,000, and returns the futures certificate to the securities box. If the player who holds a futures-speculator certificate lands on an up subspace labeled "futures," the playerwins money, e.g., $5,000, and returns the futures certificate to the securities box. If the player selects "hedger (producer)" the player buys the futures contract thinking the prices will come down. If the player holding a futures-hedger (producer) certificate then lands on a down subspace labeled "futures," the player makes money, e.g., $5,000, and returns the futures certificate to the securities box. If the player then lands on an up subspace labeled "futures," the player loses money, e.g., $2,000, and returns the futures certificate to the securities box. If the player selects "hedger (user)," the player buys the futures contract thinking that prices will go up. If the player holding a futures-hedger (user) certificate then lands on an up subspace labeled "futures," the player makes money, e.g., $5,000, and returns the card to the securities box. If the player lands on a down subspace labeled "futures," the player loses money, e.g., $2,000, and returns the futures card to the securities.

In addition, there is a middle subspace labeled "options" 148, FIG. 2C. When the player lands on this subspace, the player may buy a "call" or a "put" option and receive a securities certificate labeled accordingly. When the player purchases a call option, the player is betting that the price of the stock will go up. $1,000 is paid to buy an option. If then the player lands on an up subspace labeled "call option" the player makes money, receiving his or her $1,000 premium back plus earning a profit determined by a roll of the dice. The number on die 110 is multiplied by $1,000 to determine the amount of profit made. For instance if a 3 is rolled on die 110 the player will receive $3,000 in addition to the $1,000 premium. In one embodiment of the invention the player is allowed three times around the board to land on the call option subspace. If after three times around the board (the game's simulation of a "specified period of time" in real world option trading), the player has not landed on the subspace, the player forfeits the $1,000 premium and the options card is returned to the securities box.

If the player purchases a put option, the player is betting that the price of the stock will go down. $1,000 is paid to buy the options. If the player lands on a down subspace labeled "put option," the player makes money, receiving his or her $1,000 premium back plus a profit determined by a roll of the dice. The number on die 110 is multiplied by $1,000 to determine the amount of profit made in addition to the $1,000 premium. As with call options, the player in one embodiment is allowed three times around the board to land on a call option subspace. If after three times around the board the player does not land on the subspace, the premium is forfeited and the option card is returned to the securities box. In one embodiment the Futures and Options spaces are not required for play nor are these securities required to be purchased to complete individual portfolio asset allocation card, but are introduced as an added challenge element to the game for those advanced players and as an exposure to the high risk associated with their trades.

Finally, there are up and down subspaces labeled "IPO" (initial public offering) 152, 154 (FIG. 2A). If a player lands on an up subspace labeled IPO, the player may purchase an IPO certificate for $3,000 in one embodiment. If a player lands on a down subspace labeled "IPO," the player may purchase an IPO certificate for $2,000 in one embodiment. Regardless of whether the player lands on an up subspace or a down subspace labeled "IPO," the player may not sell the IPO certificate. Instead, the player holds the certificate until "IPO results" are made "public" when that player draws a question card "announcing" the IPO results. In one embodiment, each question card from each question category includes an indicator of results in the corner, e.g., an up or down arrow with the word IPO inside it. When the player lands on a middle subspace and draws a question card with such an up arrow, the player will make $5,000. If the player draws a question with a down arrow, the player will return the IPO certificate to the securities box for repurchase by other players and will lose the money paid for the IPO certificate. In one embodiment, there is only one IPO certificate for purchase since results will be frequent, thus permitting other players a chance at obtaining the IPO card.

In one embodiment of the invention, the game can be used for various levels of play. For instance, the entire board can be used, including all spaces. This is the standard level of play.

If a more basic level of play is desired, in one embodiment of the invention, no questions are asked and subspaces such as Futures, Options and IPO are not used. Players use only the up and down subspaces to buy stocks, bonds and mutual funds as shown on their individual portfolio asset allocation cards. Each player is given $20,000 at start of game and simply tries to purchase all needed certificates while spending as little as possible, all the while learning terms and practicing good investing habits.

In still another level of play, questions only can be asked. For instance a player may start with $1,000 and take turns trying to answer questions correctly from the "Bulls & Bears" and "The Fed/World Economies" categories to earn money. Players can select $100, $200, $500, or $1,000 questions. In such a level of play, as an option, players can lose the money value of the question for incorrect answers.

Accordingly, a game has been disclosed that is not only engaging to its players, but easy to understand by piecing together the major components of the financial world in a game that has real application. The game teaches players about various securities through their sale and purchase, teaches players about investing targets for age groups as a strategy through the use of portfolio asset allocation card guidelines, and teaches players about the investment world through questions and answers.

It should be understood that the particular embodiments described above are only illustrative of the principles of the present invention, and various modifications could be made by those skilled in the art without departing from the scope and spirit of the invention. Thus, the scope of the present invention is limited only by the claims that follow.

What is claimed is:

1. A financial board game, comprising:

a board having a closed loop path including a plurality of spaces, wherein each space represents a single playing piece step;

wherein at least some of the spaces are subdivided into a plurality of subspaces, including an up subspace and a down subspace;

wherein the up subspace specifies a respective first security to be bought or sold at a respective high price;

wherein the down subspace specifies a respective second security to be bought or sold at a respective low price; and a move indicator indicating how many spaces a playing piece is to be moved and in which subspace of a subdivided space the playing piece is to be placed.

2. The financial board game of claim 1, further comprising:

at least one portfolio identifier, wherein each portfolio identifier specifies a respective portfolio of securities to be accumulated by a player for at least one investment strategy.

3. The financial board game of claim 2, wherein the portfolio identifier is a portfolio asset allocation card and wherein there are a plurality of portfolio asset allocation cards, each card specifying securities to be accumulated for a respective one of a plurality of investment strategies.

4. The financial board game of claim 1, wherein the plurality of subspaces further includes a third subspace, wherein at least some of the third subspaces indicate that a question is to be answered.

5. The financial board game of claim 1, wherein the move indicator is a pair of dice.

6. The financial board game of claim 1, wherein the move indicator is a pair of dice, wherein a first die in the pair indicates how many spaces the playing piece is to advance and the second die in the pair indicates in which subspace the playing piece is to be placed.

7. A financial board game, comprising:

a board having a closed loop path including a plurality of spaces, wherein each space represents a single playing piece step;

wherein at least some of the spaces are subdivided into a plurality of subspaces, including an up subspace and a down subspace;

wherein the up subspace specifies a respective first security to be bought or sold at a respective high price;

wherein the down subspace specifies a respective second security to be bought or sold at a respective low price;

a move indicator indicating how many spaces a playing piece is to be moved and in which subspace of a subdivided space the playing piece is to be placed;

at least one portfolio identifier, wherein each portfolio identifier specifies a respective portfolio of securities to be accumulated by a player for at least one investment strategy.

8. The financial board game of claim 7, wherein the portfolio identifier is a portfolio asset allocation card and wherein there are a plurality of portfolio asset allocation cards, each card specifying securities to be accumulated for a respective one of a plurality of investment strategies.

9. The financial board game of claim 7, wherein the plurality of subspaces further includes a third subspace, wherein at least some of the third subspaces indicate that a question is to be answered.

10. The financial board game of claim 7, wherein the move indicator is a pair of dice.

11. The financial board game of claim 7, wherein the move indicator is a pair of dice, wherein a first die in the pair indicates how many spaces the playing piece is to advance and the second die in the pair indicates in which subspace the playing piece is to be placed.

12. A financial board game, comprising:

a plurality of portfolio asset allocation cards, wherein each respective portfolio asset allocation card specifies a portfolio of securities for one of a plurality of investment strategies, wherein a player holding the respective portfolio asset allocation card is to accumulate the securities specified on the portfolio asset allocation card;

a board having a closed loop path including a plurality of spaces, wherein each space represents a single playing piece step;

wherein at least some of the spaces are subdivided into a plurality of subspaces, including an up subspace, a down subspace, and a third subspace;

wherein the up subspace specifies a first respective security to be bought or sold at a high price;

wherein the down subspace specifies a second respective security to be bought or sold at a low price;

wherein the third subspace specifies that a question is to be answered;

a pair of dice;

wherein a first die in the pair includes a representation of a number on each of its sides indicative of a number of spaces to move a playing piece, wherein a second die in the pair includes a representation of the subspace upon which the playing piece is to be placed once the playing piece has moved the number of spaces indicated by the first die.

13. The financial board game of claim 12, further comprising a plurality of question cards, wherein when a playing piece is placed on the third subspace a question is asked from one of the plurality of question cards.

14. A method of playing a financial board game by a player, the method comprising:

on a board having a closed loop path including a plurality of spaces wherein each space represents a single playing piece step, moving a playing piece a number of spaces as indicated by a move indicator to a destination space, wherein at least some of the destination spaces have an up subspace and a down subspace;

moving the playing piece into the up subspace or the down subspace of the destination space as indicated by the move indicator;

accumulating securities in accordance with a predetermined portfolio, wherein accumulating securities includes:

if the playing piece is in an up subspace, buying or selling a first security designated by the up subspace at a high price;

if the playing piece is in a down subspace, buying or selling a second security designated by the down subspace at a low price.

15. The method of claim 14, wherein the move indicator is a pair of dice, wherein a first die in the pair indicates how many spaces the playing piece is to move and wherein a second dice in the pair indicates in which subspace the playing piece is to be placed.

16. The method of claim 14, wherein at least some of the spaces further have a middle subspace, wherein the step of moving the playing piece into an up subspace or a down subspace further includes moving the playing piece into the middle subspace, and wherein if the playing piece is in a middle subspace, a question is asked of the player.

17. The method of claim 14, wherein the predetermined portfolio is specified on a portfolio asset allocation card held by the player.

* * * * *